United States Patent [19]

Suher et al.

[11] Patent Number: 4,613,195

[45] Date of Patent: Sep. 23, 1986

[54] CARTRIDGE FUSE TERMINAL ADAPTER

[75] Inventors: Frank Suher, Chesterfield, Mo.; Glen Dunn, Fairview, N.C.; Vernon Spaunhorst, Washington; Angelo Urani, St. Louis, both of Mo.

[73] Assignee: Cooper Industries, Inc., Houston, Tex.

[21] Appl. No.: 711,527

[22] Filed: Mar. 14, 1985

[51] Int. Cl.[4] ..... H01R 13/35

[52] U.S. Cl. ..... 339/31 R; 339/154 A

[58] Field of Search ..... 339/31, 150 A, 153, 339/154, 186

[56] References Cited

U.S. PATENT DOCUMENTS 819,657 5/1906 Hubbell ..... 339/154 R

FOREIGN PATENT DOCUMENTS 409906 5/1934 United Kingdom ..... 339/153

*Primary Examiner*—Joseph H. McGlynn

*Attorney, Agent, or Firm*—Nelson A. Blish; Eddie E. Scott; Alan R. Thiele

[57] ABSTRACT

A terminal adapter for a cartridge fuse accommodating the installation of the fuse in fuse holders of a different size and type while at time insuring the installation of the proper class of fuse in a particular application.

15 Claims, 15 Drawing Figures

FIG.1
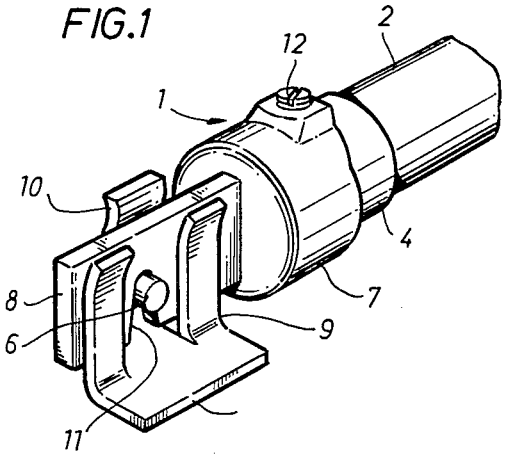
FIG.2
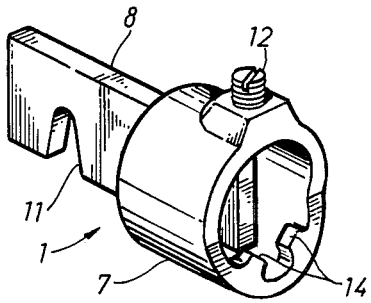
FIG.3
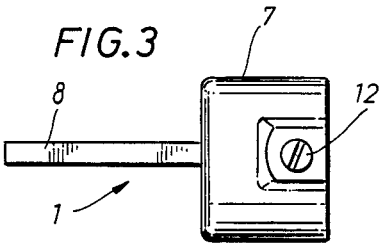
FIG.4
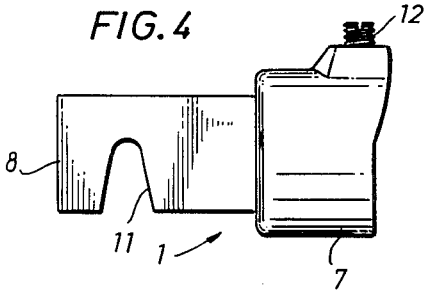
FIG.5
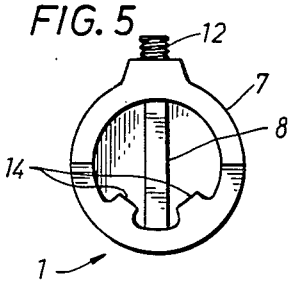
FIG.6
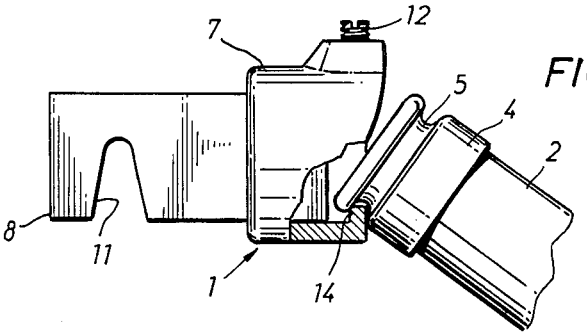
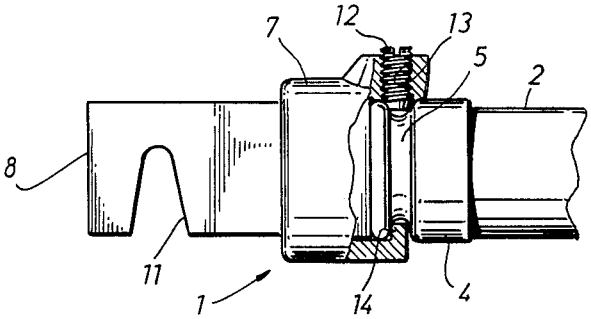
FIG.7

FIG.8
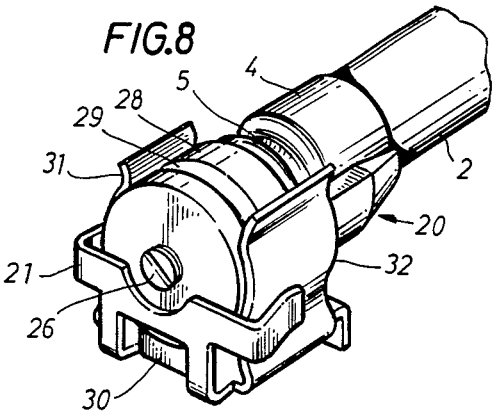
FIG.9
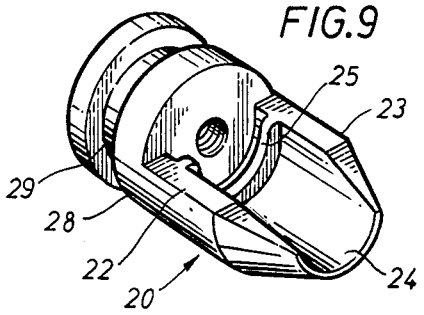
FIG.10
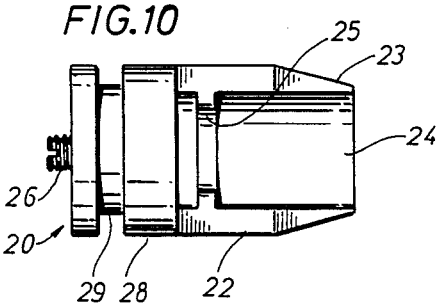
FIG.11
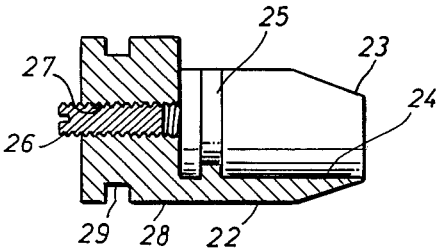
FIG.12
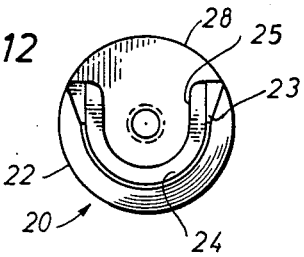
FIG.13
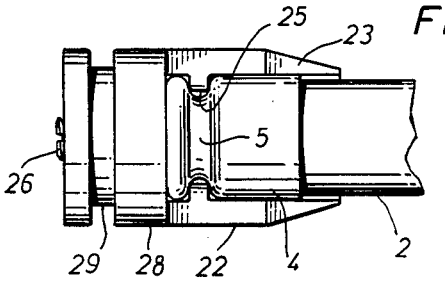
FIG.14
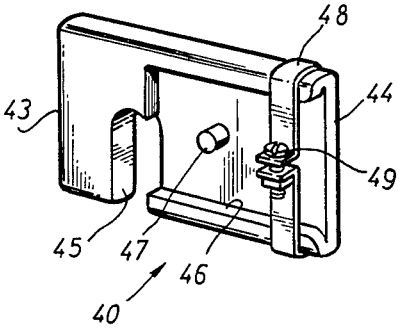
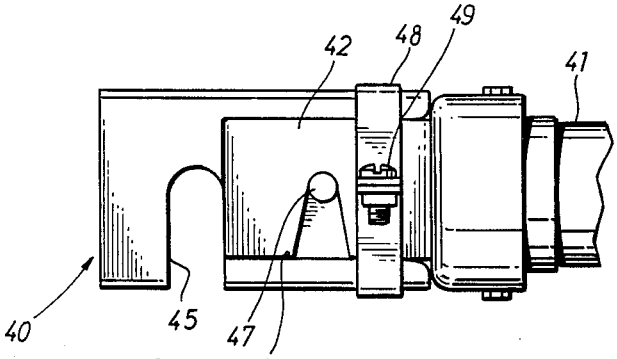
FIG.15

CARTRIDGE FUSE TERMINAL ADAPTER

BACKGROUND OF THE INVENTION

1. Field of the Invention

This invention relates to cartridge fuses and in particular to a terminal adapter accommodating the installation of cartridge fuses in a variety of fuse holders.

2. Description of the Prior Art

The prior art includes a number of terminal adapters for securing cartridge fuses in a variety of fuse holders as well as rejection type fuse holders designed to insure the installation of the proper class of fuse in a particular application.

The terminal adapters shown in U.S. Pat. Nos. 2,889,533 and 4,128,291 are fairly typical of the adapters heretofore in use. For example, U.S. Pat. No. 2,889,533 shows a clip-type fuse holder incorporating an adapter accommodating the installation of a fuse having either ferrule or knife-blade type terminals. Similarly, U.S. Pat. No. 4,128,291 shows a clip-type fuse holder having an adapter accommodating the installation of fuses having different size ferrule terminals.

While the foregoing arrangements have been for the most part satisfactory, providing a structure which maintains adequate contact between the fuse terminals and the fuse holder to prevent overheating due to high resistance in the joints between those members has continued to be an area of concern. This is particularly the case with clip-type fuse holders where the terminals of the fuses are typically wedged between the cantilevered legs of the U-shaped fuse holders. Thus, proper sizing of the fuse terminals for a particular fuse holder is important to insure the integrity of the electrical connection between those members.

In addition to the above, the prior art also includes a number of rejection type fuse holders which have been used to prevent the installation of the wrong class of fuse in a particular application. Fuse holders of this type have been necessary since many cartridge fuses are the same size and current rating but have different current interrupting capacities. For example, a current limiting, high interrupting capacity, class R cartridge fuse is essentially the same size as a non-current limiting, low interrupting capacity, class H fuse.

Obviously, since the current limiting, class R fuse incorporates the additional protective feature of extremely fast operation to prevent the flow of extremely high currents as compared to a non-current limiting fuse, a potentially hazardous situation could result if a class H fuse was inadvertantly substituted for a class R fuse. Consequently, it has generally been required to incorporate some means in the fuse holder to prevent the replacement of the current limiting fuse with a non-current-limiting fuse. U.S. Pat. Nos. 4,099,828 and 4,108,531 show two rejection fuse holders which were designed to secure class R cartridge fuses having ferrule and knife-blade terminals, respectively. In both cases, one terminal on each of the fuses is provided with a notch or groove keyed to the rejection fuse holder which accepts the keyed terminal of the class R fuse but does not accept the unkeyed terminal of a class H fuse.

SUMMARY OF THE INVENTION

This invention relates to cartridge fuses and in particular to terminal adapters accommodating the installation of cartridge fuses in fuse holders of a different size and type than the fuses while insuring the installation of the proper class of fuse in a particular application.

The invention contemplates securing the terminal adapters to the terminals of fuses having at least one notched terminal indicating the classification of the fuse which is keyed to a particular rejection fuse holder. Since the rejection fuse holder will only accept and retain fuse terminals of the same class and size as the fuse it is designed to retain, the terminal adapters provide a means of securing different types and sizes of fuses in the same rejection fuse holder depending on the operating requirements of the particular circuit involved.

Each of the terminal adapters includes a body having a receiver formed in its inner end sized to receive the notched fuse terminal, a projecting portion positioned within the receiver to prevent the installation of an unnotched fuse terminal within the receiver, a clamping arrangement for releasibly securing the terminal in the receiver, and a notched terminal on the outer end of the body sized to fit in the desired rejection fuse holder. This arrangement accommodates securing a variety of fuses of different sizes and types in the same rejection fuse holder, or alternatively, the same fuse in a variety of rejection fuse holders, while insuring the proper class of fuse is used.

From the foregoing, it can be seen that the terminal adapters embodying the invention can be used to secure fuses having either ferrule or knife-blade type terminals to rejection fuse holders adapted to secure either type of terminal. Moreover, the relatively straight-forward design of the adapters provides an inexpensive and easily fabricated arrangement which enables a workman to readily correct or update the protection within a circuit commensurate with its operating requirements. With this in mind, it is to be understood that various changes can be made in the arrangement, form and construction of the apparatus disclosed herein without departing from the scope and spirit of the invention.

DESCRIPTION OF THE DRAWINGS

FIG. 1 is a partial perspective view showing a first embodiment of the fuse terminal adapter securing a cartridge fuse having ferrule terminals to a knife-blade type rejection fuse holder;

FIG. 2 is a perspective view of the adapter shown in FIG. 1;

FIG. 3 is a plan view of the adapter shown in FIG. 2;

FIG. 4 is a side elevational view of the adapter shown in FIG. 2;

FIG. 5 is an end elevational view of the adapter shown in FIG. 2;

FIGS. 6 and 7 are sequential partial side elevational views showing the method of securing the fuse terminal ferrule of the cartridge fuse within the adapter shown in FIGS. 1–5;

FIG. 8 is a partial perspective view showing a second embodiment of the fuse terminal adapter securing a cartridge fuse having ferrule terminals to a ferrule type rejection fuse holder;

FIG. 9 is a perspective view of the adapter shown in FIG. 8;

FIG. 10 is a plan view of the adapter shown in FIG. 9;

FIG. 11 is a longitudinal cross-sectional view of the adapter shown in FIG. 9;

FIG. 12 is an end elevational view of the adapter shown in FIG. 9;

FIG. 13 is a partial plan view showing the ferrule terminal of a cartridge fuse secured within the adapter shown in FIGS. 8–12;

FIG. 14 is a perspective view of a third embodiment of the fuse terminal adapter; and FIG. 15 is a partial side elevation view showing the adapter shown in FIG. 14 secured to a cartridge fuse having a knife-blade terminal.

DESCRIPTION OF THE PREFERRED EMBODIMENTS

Referring to FIG. 1, the first embodiment of the invention comprises a fuse terminal adapter 1 suitable for coupling a class R ferrule type cartridge fuse 2 to a class R knife-blade type rejection fuse holder 3. As can be seen from the drawings, the ferrule 4 of the cartridge fuse 2 is provided with an annular peripheral notch or groove 5 conforming to the class R fuse requirements of the National Electric Code, and the rejection fuse holder 3 is provided with a suitable post or pin 6 designed to prevent the installation of other class R fuses as is well known in the art.

The body of the terminal adapter 1 includes a cylindrical receiver 7 sized to receive the ferrule 4 in one end, and a notched plate 8 secured to the other end of the receiver 7 providing a knife-blade type terminal sized to be tightly clamped between the cantilevered legs 9 and 10 of the rejection fuse holder 3 in the conventional fashion, it being noted that a notch 11 provided in the notched plate 8 is sized to fit around the pin 6.

As shown in FIGS. 2–7, the ferrule 4 is clamped between a pair of inwardly projecting tangs 14 formed in the interior of the receiver 7 which are sized to fit in the annular groove 5, and a set screw 12 which is secured in a threaded bore 13 extending through the wall of the receiver 7 diametrically opposite the tangs 14. This arrangement facilitates positioning the ferrule 4 within the receiver 7 by simply engaging the annular groove 5 on the tangs 14 as shown in FIG. 6 and then rotating the adapter and fuse into axial alignment as shown in FIG. 7. Thereafter, the adapter can be easily secured to the ferrule 4 by simply tightening the set screw 12 to firmly clamp the ferrule 4 within the receiver 7.

FIGS. 8–13 illustrate a second embodiment of the invention comprising a fuse terminal adapter 20 for coupling the class R ferrule type cartridge fuse 2 to a class R ferrule type rejection fuse holder 21. As illustrated in the drawings, the fuse holder 21 is designed to secure a cartridge fuse having a larger diameter ferrule than the ferrule 4 of the fuse 2.

In this embodiment, the body of the adapter 20 is provided with a receiver 22 having a semi-circular coupling flange 23 which forms a generally U-shaped slot 24 sized to laterally receive the ferrule 4. Additionally, to prevent a workman from using the adapter 20 on other than class R fuses, an annular rib 25 is formed on the interior of the flange 23 within the slot 24 which fits within the annular groove 5.

The adapter 20 is clamped to the ferrule 4 by a set screw 26 which is secured in a threaded bore 27 extending through the outer end of the adapter. This arrangement allows a workman to secure the adapter 20 to the ferrule 4 by simply positioning the ferrule in the slot 24 and then tightening the set screw 26 to firmly clamp the ferrule between the annular rib 25 and the set screw 26.

As shown in the drawings, the outer end of the adapter 20 is provided with an enlarged ferrule 28 relative to the diameter of the ferrule 4 on the fuse 2. The enlarged ferrule 28 is also provided with an annular groove 29 about its periphery which conforms to the class R fuse requirements and is keyed to or sized to receive an obstructing flange 30 in the rejection fuse holder 21. This arrangement enables a workman to simply press the ferrule 28 between the opposing legs 31 and 32 of the rejection fuse holder 21 to secure the adapter 20 to the fuse holder while at the same time providing a means of insuring that only class R fuses are installed in the circuit concerned.

FIGS. 14 and 15 illustrate a third embodiment of the invention comprising a fuse terminal adapter 40 for coupling a class R cartridge fuse 41 having a knife-blade type terminal 42 to a class R rejection fuse holder such as the fuse holder 3 shown in FIG. 1 which is adapted to secure a larger knife-blade type terminal.

As shown in the drawings, the body of the adapter 40 is formed from a metal plate 43 having a receiver 44 formed in one end and a suitable notch 45 formed in its other end adapted to accommodate its installation in a class R rejection fuse holder. The receiver 44 is formed by a recess 46 cut in the metal plate 43 which is sized to receive the knife-blade terminal 42, and, to insure that the adapter is only used with class R fuses, a post or pin 47 is positioned within the recess 46 to prevent the installation of an unnotched knife-blade terminal in the receiver 44.

The adapter 40 is secured to the knife-blade terminal 42 by a metal strap 48. The strap 48 is wrapped around the plate 43 and is releasably secured together by a nut and bolt 49 or other suitable coupling enabling a workman to readily secure the adapter to the fuse terminal. In this regard, it should also be noted that the rejection fuse holder also serves to clamp the terminal 42 to the adapter 40. Specifically, by sizing the recess 46 so that it extends to the edge of the notch 45, the invention provides an arrangement which positions the terminal 42 in a manner effectively utilizing the clamping force of the fuse holder to further assure the integrity of the joint between the adapter 40 and the terminal 42.

We claim:

1. For a fuse adapted to be secured in a first rejection fuse holder including a notched fuse terminal having a first notched portion sized to receive a first projecting portion within the fuse holder, an adapter for coupling the fuse to a second rejection fuse holder having a second projecting portion, comprising:

a body having inner and outer ends;

a receiver portion formed in the inner end of the body sized to receive the notched fuse terminal, said receiving portion including a third projecting portion sized to prevent the installation of an unnotched fuse terminal within the receiver portion while accommodating the installation of the notched fuse terminal within the receiver portion with the third projecting portion engaged within the first notched portion;

clamping means adapted to secure the notched fuse terminal within the receiver portion; and a second notched portion in the outer end of the body sized to receive the second projecting portion to accommodate coupling the adaptor to the second rejection fuse holder.

2. The adapter for the fuse of claim 1 wherein the notched fuse terminal is a generally cylindrical ferrule having an annular groove about its periphery, and said receiver portion being provided with a socket sized to axially receive the ferrule in a complementary fashion; and at least one annular tang forming said third projecting portion sized to fit into the annular groove projecting inwardly into the socket along a portion of its interior periphery.

3. The adapter according to claim 2, and said second notched portion being a knife-blade type terminal having a notch complementary with the second projecting portion of the second rejection fuse holder.

4. The adapter according to claim 2, and said receiver portion being of a generally tubular configuration; and said second notched portion being a knife-blade type terminal projecting outwardly along the axis of said tubular receiving portion.

5. The adapter according to claim 2, and said clamping means being diametrically opposed to the annular tang within the socket to accommodate clamping the ferrule between the clamping means and the annular tang.

6. The adapter according to claim 5, and said clamping means being a set screw threaded through the receiver portion.

7. The adapter for the fuse of claim 1 wherein the notched fuse terminal is a generally cylindrical ferrule having an annular groove about its periphery, and said receiver portion being provided with a semi-cylindrical coupling flange forming a generally U-shaped slot adapted to laterally receive the ferrule in a complementary fashion; and said third projecting portion being an annular rib in said flange sized to fit into the annular groove projecting inwardly into the slot along its interior periphery.

8. The adapter according to claim 7, and said second notched portion being a ferrule-type terminal having an annular groove about its periphery complementary with the second projecting portion of the second rejection fuse holder.

9. The adapter according to claim 7, and said clamping means being axially aligned within the outer end of the body to accommodate clamping the ferrule between the annular rib and the clamping means.

10. The adapter according to claim 9, and said clamping means being a set screw threaded through the outer end of the body.

11. The adapter for the fuse of claim 1 wherein the notched fuse terminal is a knife-blade type terminal having a notch in one of its edges, and said body being a relatively flat plate wherein said receiver portion includes a recess in the plate sized to receive the knife-blade type terminal in a generally contiguous fashion; and said third projecting portion being a post positioned within the recess which is sized to fit within the notch of the knife-blade type terminal when said terminal is secured within the recess.

12. The adapter according to claim 11, and said clamping means being a tension strap adapted to be releasibly secured about the receiver portion and the knife-blade type terminal.

13. The adapter according to claim 11, and said second notched portion being a knife-blade type terminal having a notch complementary with the second projecting portion of the second rejection fuse holder.

14. The adapter according to claim 11, and the depth of said recess being approximately the same as the thickness of said knife-blade terminal.

15. The adapter according to claim 14, and said recess being adjacent to said notch in the second notched portion.

* * * * *